United States Patent [19]

Wetzel

[11] Patent Number: 4,461,220

[45] Date of Patent: Jul. 24, 1984

[54] ADJUSTABLE FOLDING TABLE AND HANGER

[76] Inventor: Elmer Wetzel, 412 Avenue F West, Bismarck, N. Dak. 58501

[21] Appl. No.: 357,816

[22] Filed: Mar. 15, 1982

[51] Int. Cl.[3] ..... E05G 3/00

[52] U.S. Cl. ..... 108/30; 108/50; 248/156

[58] Field of Search ..... 108/30, 128, 50; 248/156, 155.3

[56] References Cited

U.S. PATENT DOCUMENTS

| | | | |
|---|---|---|---|
| 103,387 | 5/1870 | Sutton | 108/30 |
| 338,039 | 3/1886 | Lochner | 108/30 |
| 861,810 | 7/1907 | Coblentz | 108/115 |
| 1,601,569 | 9/1926 | Kennedy | 108/128 |
| 1,666,293 | 4/1928 | Lorton | 108/30 |
| 1,890,409 | 12/1932 | Roberts | 108/50 X |
| 2,137,799 | 11/1938 | Brandenburg | 155/135 |
| 2,217,031 | 10/1940 | Sutton | 311/80 |
| 2,750,243 | 6/1956 | Zielfeldt | 311/62 |
| 2,799,543 | 7/1957 | Tomaselli | 108/50 |
| 3,058,711 | 10/1962 | Kingsford | 248/156 X |
| 3,177,825 | 4/1965 | Jones | 108/128 |
| 3,199,818 | 8/1965 | Ahara | 248/156 |
| 3,215,095 | 11/1965 | Keppeler | 108/50 |
| 3,638,585 | 2/1972 | Futrell | 108/9 |

FOREIGN PATENT DOCUMENTS

| | | | |
|---|---|---|---|
| 928204 | 11/1947 | France | 108/128 |
| 482696 | 9/1953 | Italy | 108/50 |

*Primary Examiner*—William E. Lyddane
*Assistant Examiner*—Peter A. Aschenbrenner
*Attorney, Agent, or Firm*—Kinney & Lange

[57] ABSTRACT

A table includes a substantially vertical support member having a lower ground engaging portion and first and second leaves pivotally attached to each other and adjustably connected to the vertical support member. A support linkage supports the first and second leaves in an up position and pivotally connects the first and second leaves to the vertical support member such that the leaves are movable to a down position. When the leaves are in the down position, the support linkage and the support member are disposed within the same plane with the leaves adjacent the support on diametrically opposite sides forming a compact unit. Preferably, an article hanger is slidably attached to an upper end of the vertical support member such that the hanger's height is adjustable and is lockable at a determined height for hanging an article such as a lantern.

20 Claims, 9 Drawing Figures

ADJUSTABLE FOLDING TABLE AND HANGER

BACKGROUND OF THE INVENTION

1. Field of the Invention

The present invention relates to tables having foldable table tops which are foldable into a compact unit.

2. Description of the Prior Art

Many times it is desirable to have a table for use during leisure outdoor activities. Such a table should be easy to transport and require little effort to set up. Normally, such a table would be a foldable table, foldable to an easy carrying form. Foldable tables are well known in the art. However, the tables disclosed in the prior art do not provide a versatile table that is amenable to a range of various outdoor activities, such as fishing at a river or lakeshore or simply sitting and enjoying the outdoors in one's backyard. In either of the above examples, a table is useful for placement of various articles such as fishing tackle or food and refreshments. Some examples of the prior art foldable tables and other structures for supporting articles are set forth in the patents briefly described below.

The Sutton U.S. Pat. No. 2,217,031 shows a table that is collapsible by first folding the feet which support the center post vertically and then folding the center post about a pivot with respect to the table top. Although the table of the Sutton Patent is foldable, the manner in which the table is foldable makes the table awkward to carry.

The Zielfeldt U.S. Pat. No. 2,750,243 also shows a table which has four legs hinged to the top of the table such that the table is folded. The table further has a hand hold on one edge for carrying the table in a folded position. However, the table of the Zielfeldt Patent is awkward in many outdoor situations due to the four legs.

The Futrell U.S. Pat. No. 3,638,585 shows a combination lecturn and table. The table has two halves, one half being foldable along the supporting post and the other half is removable. The lecturn and table of the Futrell Patent would be awkward to carry due to the removable half of the table top.

The Sutton U.S. Pat. No. 103,387 discloses a table with four equally spaced radially extending support arms. The support arms support four individual table tops, each top being pivotal downwardly independent of the other table tops. Although the table tops are foldable with respect to the main support, the table shown in the Sutton Patent would be awkward to carry since the radially extending support arms still extend horizontally from the center post.

The Coblentz U.S. Pat. No. 861,810 shows a wash stand having a base supported by feet at a central post extending upwardly from the base. A table top is pivotally attached at the top of the support post and pivots outwardly when a support arm is detached from the underside of the table top. The wash stand, however, would be awkward to use in most outdoor types of activities where a table would be useful.

The Brandenburg U.S. Pat. No. 2,137,799 and the Jones U.S. Pat. No. 3,177,825 both illustrate foldable chairs. Although the chairs fold into a generally compact structure for carrying, they have little value as a table for supporting articles thereon.

The Lorton U.S. Pat. No. 1,666,293 illustrates a campfire outfit having a central post with a lower portion for insertion into the ground. Various articles are then attached to the central post, such as a rack, on which other articles may be placed or food cooked.

SUMMARY OF THE INVENTION

The present invention includes a table having a substantially vertical support member with a lower ground engaging portion. First and second leaves form a table top and are pivotally attached to each other. A support linkage supports the first and second leaves about the vertical support and is pivotally attached to the underside of the leaves at an upper end and is pivotally and slidably connected to the vertical support member. The support linkage and the support member are disposed within the same plane when the leaves are pivoted to a down position for folding the table into a compact and easily transportable unit. Preferably, a hanger is attached to an upper end of the vertical support member and is adjustable to a desired height above the table top.

DETAILED DESCRIPTION OF THE PREFERRED EMBODIMENTS

Figure 1:
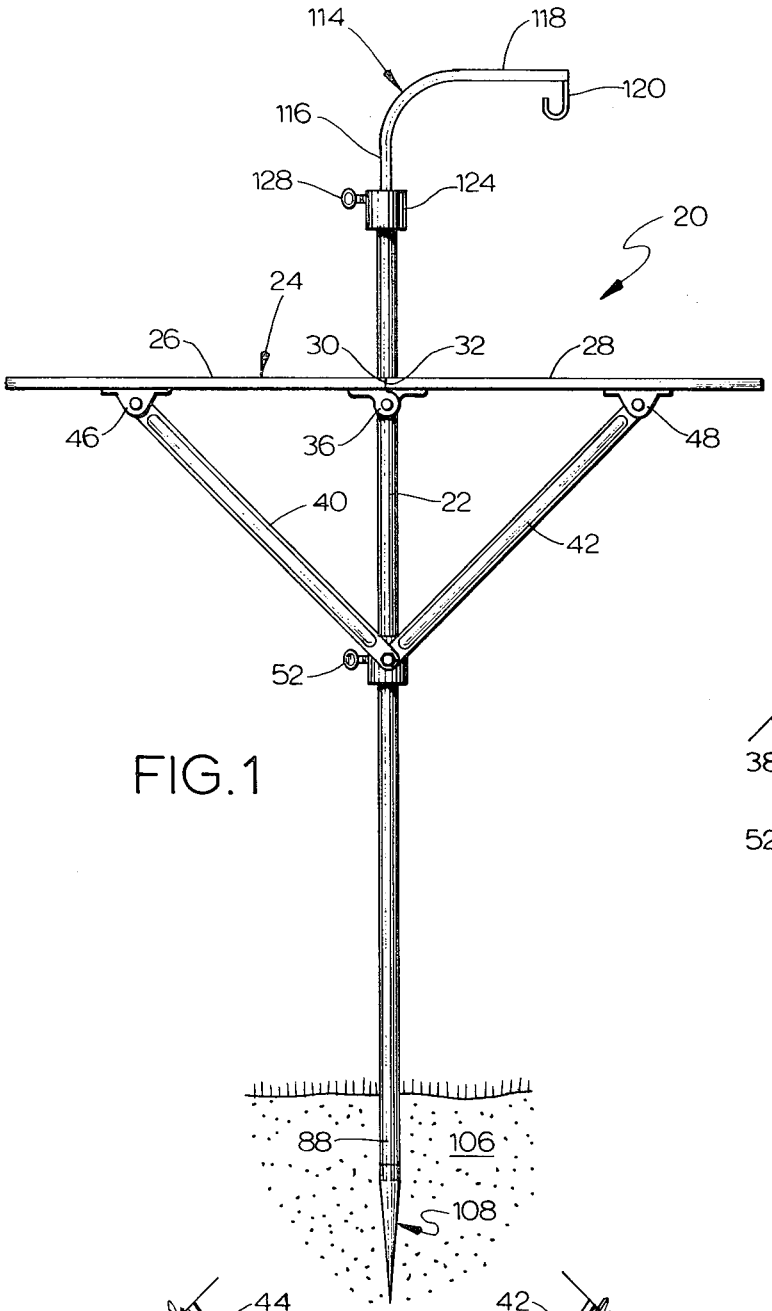
FIG. 1 is a side view of a table of the present invention in an upright position.

The table of the present invention is generally indicated at 20 in FIG. 1. The table includes a substantially vertical support post 22 defining a vertical axis and a substantial horizontal table top 24 having first and second leaves 26, 28, respectively. The leaves 26, 28 when in a substantially horizontal position form the table top 24 and are adjacent each other along inside edges 30, 32. Leaves 26, 28 are disposed about the vertical post 22 such that the post 22 extends centrally through the table top.

Figure 2:
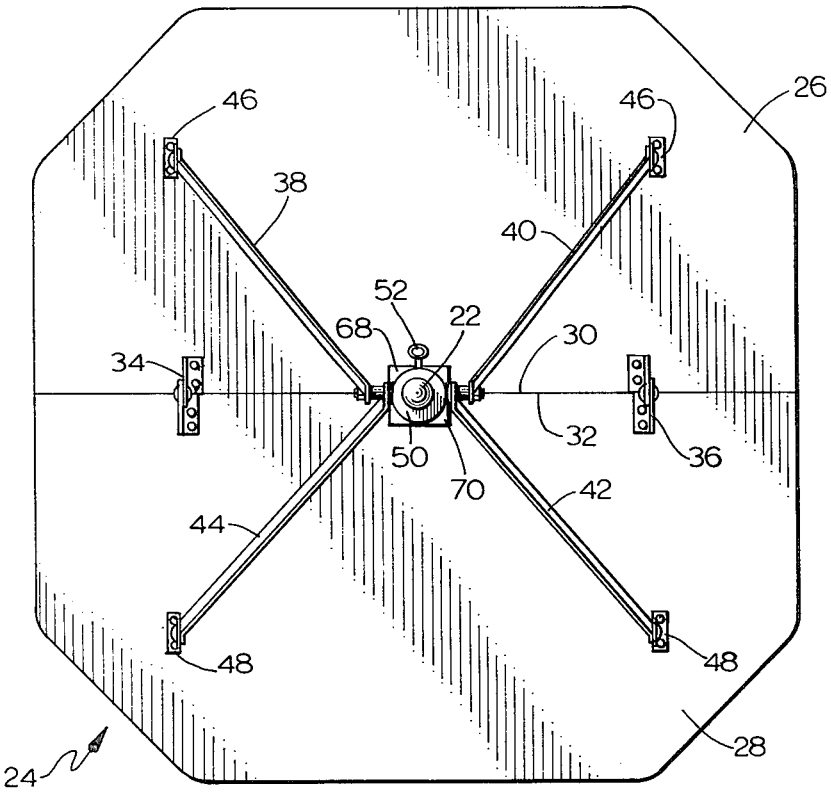
FIG. 2 is a bottom view of the table in the upright position.

As illustrated in FIG. 2, the first and second leaves 26, 28 are pivotally attached to each other by suitable hinges 34, 36 which are attached to the underside surfaces of the first and second leaves 26, 28 by suitable fasteners, such as rivets. The first and second leaves pivot about a first horizontal axis that is disposed through the vertical axis of the post 22.

Figure 3:
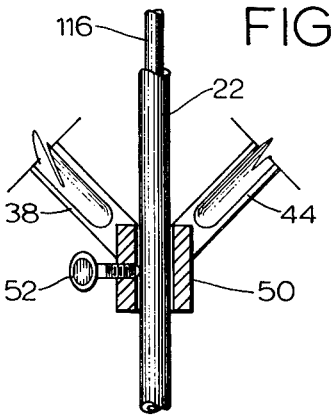
FIG. 3 is a fragmentary partial cross sectional view of the height adjusting and locking mechanism used for adjusting the height of the table top of the present invention.

The first and second leaves 26, 28 are supported by a support linkage having support arms 38, 40, 42, and 44. The support arms 38 and 40 are pivotally connected at upper ends to the first leaf by suitable pivot hinges 46 which are fixedly attached to an underside surface of the first leaf 26 by rivets. Similarly, the support arms 42 and 44 are pivotally attached to their upper ends to the underside of the second leaf 28 by suitable pivot hinges 48 which are fixedly attached to an underside surface of the second leaf 28 by rivets. The support arms 38 and 44 are pivotally attached at a lower end to a height adjusting collar along a second pivot axis. Similarly, the support arms 42 and 46 are pivotally attached at a lower end on a diametrically opposite side to the height adjusting collar 50 along the second pivot axis. The collar 50 is, preferably, situated substantially coaxially about the center post 22 and slidably engages the center post 22. To fix the collar at a desired height along the post 22, a thumb set screw 52 threadably engages a threaded hole which is positioned substantially perpendicular to the vertical axis of the center post 22 as illustrated in FIG. 3. A distal end of the screw 52 frictionally engages the center post 22, holding the collar 50 at any height desired along the center post 22.

Figure 4:
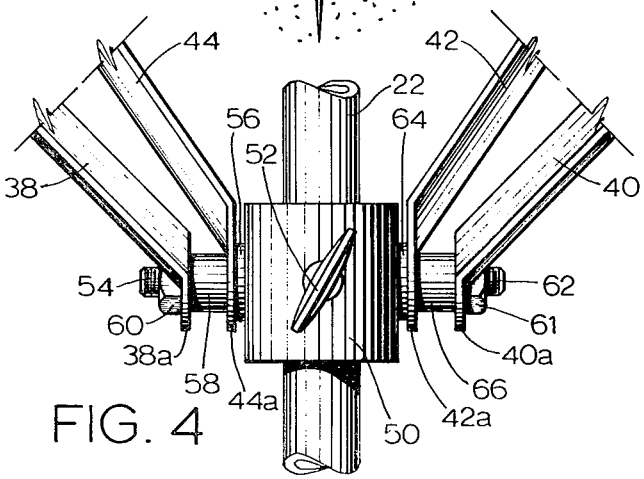
FIG 4 is an enlarged fragmentary front view of the height adjusting and locking mechanism for the tabler top and pivotal connection of the support linkage to the vertical support post.
Figure 10:
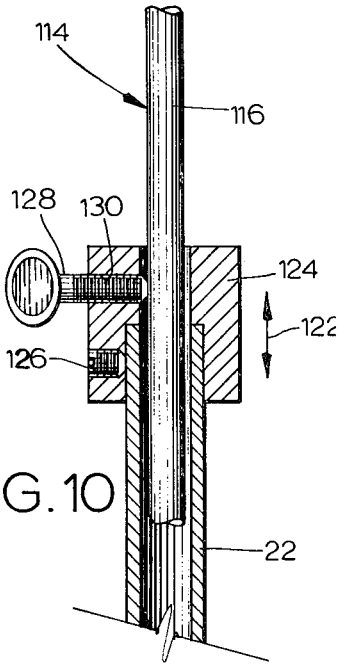
FIG. 10 is a fragmentary partial cross sectional view of the height adjusting and locking mechanism used to adjust the height and secure the hanger of the table of the present invention.

As illustrated in greater detail in FIG. 4, the support arms 44 and 38 have lower ends 44*a* and 38*a* with apertures (not shown). A rod 54 extends through the apertures and is threaded at one end and is fixedly attached to the collar 50 at an opposite end. A spacer washer 56 separates the lower portion 44*a* from the collar 50 and a spacer 58 separates the lowr portion 44*a* from the lower portion 38. A locking nut 60, threadably engaging the rod 54, holds the lower portion 44*a* and 38*a* of the support arms in pivotal connection to the collar 50. Similarly, the support arms 42 and 40 have lower portions 42*a* and 40*a* with apertures (not shown). A rod 62 extends through the apertures and has a threaded end and is fixedly attached to the collar 50 at an opposite end. A spacer washer 64 separates the lower portion 42*a* of the support arm 42 from the collar 50 and a spacer 66 separates the lower portion 42*a* of the support arm 42 from the lower portion 40*a* of the support arm 40. A locking nut 61, threadably engaging the rod 62, holds the lower portions 42*a* and 40*a* of the support arm in pivotal engagement with the collar 50. The threaded rod 54 and the threaded rod 62 lie along substantially th same pivotal axis with the support arms 38, 40, 42 and 44 pivoting about the same axis proximate their lower portions. The support arms extend upwardly and outwardly from the center post 22 proximate peripheral edges of the first and second leaves to provide adequate support for the table top.

Figure 5:
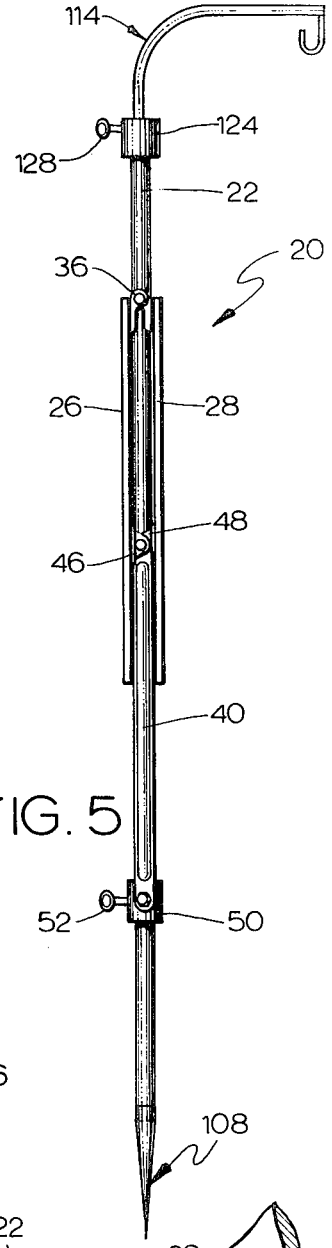
FIG. 5 is a side view of the table top folded into a compact unit.
Figure 6:
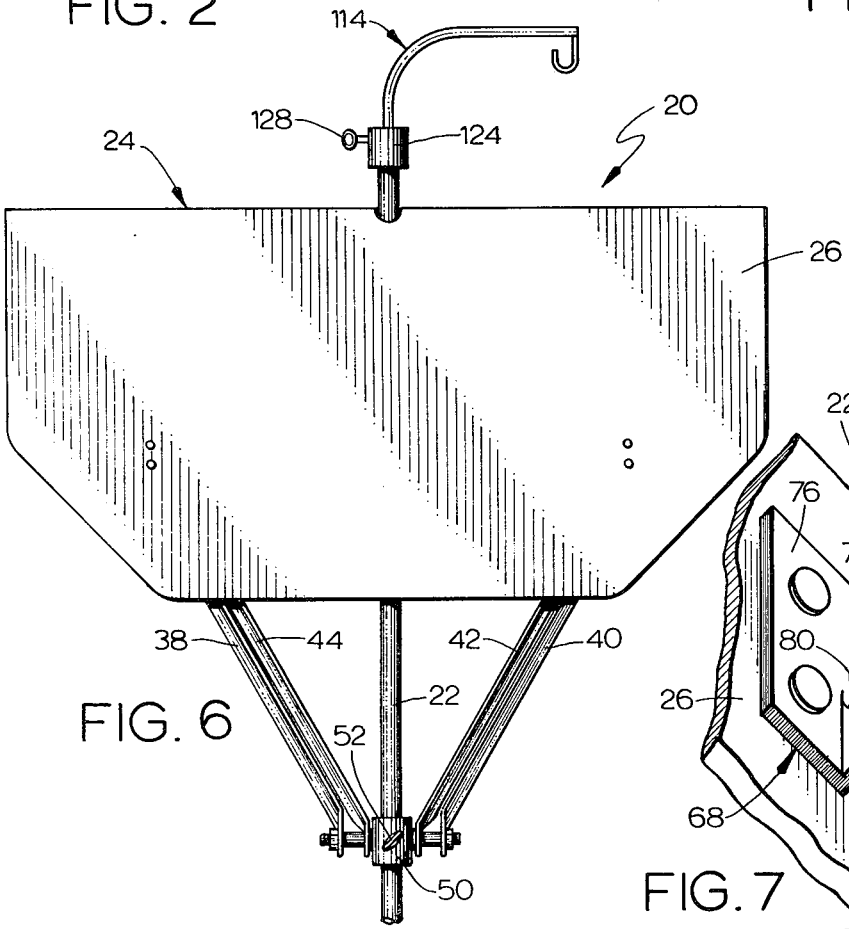
FIG. 6 is a front view of the table folded into a compact unit.

Pivoting of the lower portions of the support arms about the same pivotal axis permits all the support arms 38, 40, 42 and 44 to lie along the same plane as the center post 22 when the table top is folded, as illustrated in FIG. 5. In addition, the pivotal hinges 34 and 36, the hinges 46 and 48 and the pivotal connection of the lower portions of the support arms lie along the same plane as the support arms 38, 40, 42 and 44 and the center post 22 when the table is folded. The first and second leaves 26 and 28 are directly adjacent to the center post 22 when the table is folded, providing an extremely compact and substantially flat folded table, as illustrated in both FIGS. 5 and 6, which can be easily carried from place to place.

Figure 7:
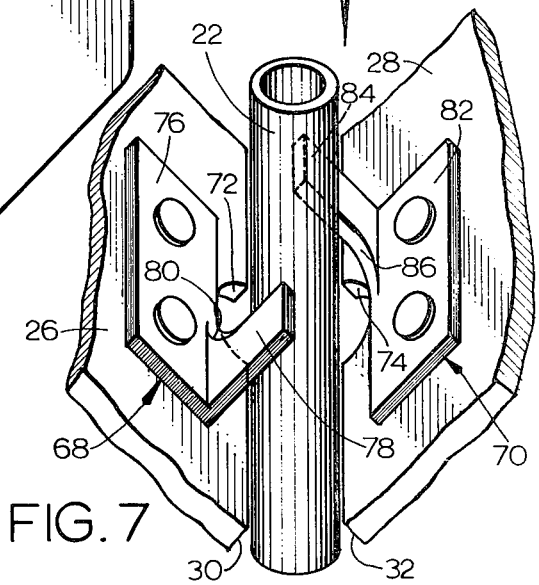
FIG. 7 is a fragmentary perspective view of the table top in a partially folded position with retainers for holding the table top about the center post when in a folded position.

The present invention also includes a first retaining device 68 attached to the underside of the first leaf 26 and a second retaining device 70 attached to the underside of the leaf 28 as shown in FIG. 7. The retaining devices 68 and 70 are positioned proximate semi-circular recesses 72, 74 located on the inside edges 30, 32, of the leaves 26, 28, respectively. The retaining device 68 includes a main flat portion adjacent to the underside of the leaf 26 and recess 72, and a retaining arm portion 78 extending substantially perpendicularly from the main flat portion 76 with a post retaining edge 80. Similarly, the guide 70 also has a main flat portion 82 adjacent the underside of the leaf 28 and recess 74, and a retaining arm portion 84 extending substantially perpendicularly from the main flat portion 82 with a post retaining edge 86. When the leaves 26 and 28 are in a substantially horizontal position, the recesses 72 and 74 surround the post 22 fixing the position of the leaves around the post 22 with the post 22 providing lateral support to the leaves. When the leaves 26, 28 are folded to a down position, the retaining arm portions 78, 84 are positioned substantially perpendicular to the axis of the post 22 with retaining edges 80 and 86 being adjacent the post 22. When the leaves are folded, the retaining arm portion 78 is positioned on one side of the post 22 and the retaining arm portion 84 is positioned on a diametrically opposing side of the post 22. When in the folded position, the arms 78 and 84 provide lateral support through the post 22 to the leaves 26, 28 such that the table top is held in a secure position when being transported.

Figure 8:
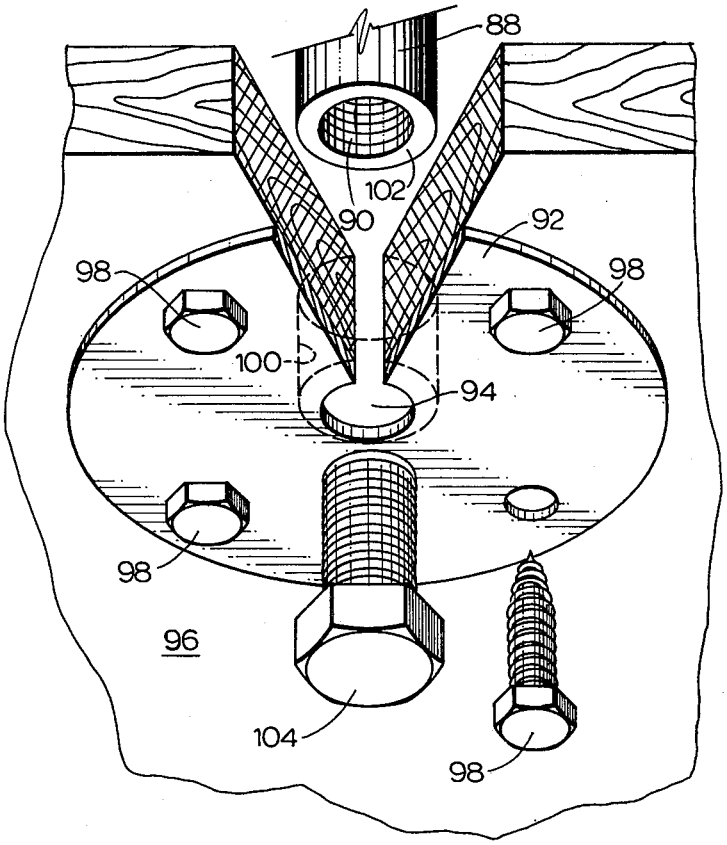
FIG. 8 is a perspective view of the apparatus used to secure the table to a wooden platform.

The post 22 has a lower portion 88 with an internally threaded aperture 90. The internally threaded aperture 90 allows the table of the present invention to be used either on the ground or on a platform such as a floor of a pontoon boat or a wooden deck. In FIG. 8, a flange 92 with a substantially central aperture 94 is placed adjacent the bottom surface of the pontoon boat floor or deck represented by board 96. The flange 92 is preferably attached by wood screws 98 extending through circumferentially spaced apertures in the flange and threadably engaging the wood 96. The lower portion 88 of the post 22 is inserted into an aperture 100 in the wood until an end surface 102 of the lower portion 88 abuts against the flange 92. A bolt 104 is inserted through the aperture 94 and threadably engages the internally threaded threads 90 of the lower portion 88 holding the post 22 in a substantially vertical position.

Figure 9:
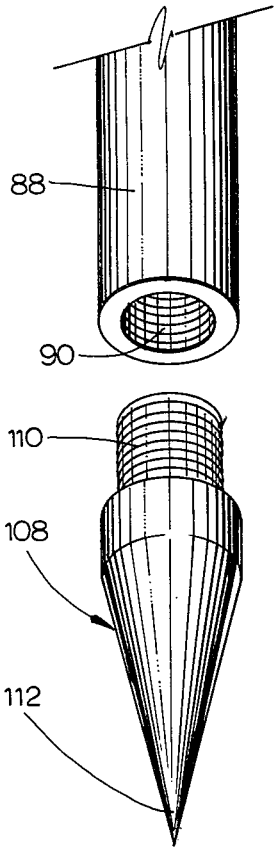
FIG. 9 is a perspective view of the end portion of the center post and detachable pointed end for insertion into the ground.

Alternatively, the post 22 is held in a substantially vertical position by inserting the lower portion 88 into the ground 106, as illustrated in FIG. 1. A pointed end 108 having a male threaded end 110 for threaded engagement with the internal threads 90 of the lower portion and a pointed ground engaging end 112, as illustrated in FIG. 9, facilitates the insertion of the lower portion into the ground.

In addition, an article hanger for hanging articles such as a lantern is attached to the post 22 at an upper end. The article-hanger 114 has a substantially vertical post engaging end portion 116 and a substantially horizontal hanging portion 118. A hook 120 is preferably attached to a free end of the hanging portion 118 for hanging a lantern. The article hanger 114 is preferably made of one piece of tubing being bent with the lower portion 116 and the horizontal portion 118 in substantially perpendicular ralationship to each other. The lower portion 116 is inserted coaxially within the post 22, as illustrated in FIG. 9, for adjusting the height of the article hanger 114 in a direction indicated by arrow 122 and for removal of the article hanger from the post 22 if desired. A collar 124, surrounding both the post 22 and the lower portion 116 of the article hanger 114, is fixedly attached to the post 22 preferably by a set screw 126 extending through the collar 124. A second thumb set screw 128 extends through a threaded aperture 130 in the collar 124. A distal end of the second thumb set screw 128 engages the lower portion 116 of the article hanger 114 against inside surfaces of the collar 124, holding the member at a desired position. To lower or raise or remove the hanger 114, the thumb set screw 128 is simply loosened allowing the hanger 114 to move within the post 22. To fix the hanger 114 at a desired height, the thumb set screw 128 is tightened.

The table of the present invention is producible in a wide range of sizes. In one working embodiment, the table top was approximately 23.5 inches in width and length and was adjustable from approximately 8 inches to 37 inches in floor height. The article hanger 114 was adjustable from approximately 3.5 inches to 36 inches above a top end of the post 22. When folded, the table was approximately only 1.5 inches thick measured from top surface of the first leaf 26 to top surface of the second leaf 28. The table described immediately above is of sufficient size for most outdoor activities and is foldable to a size that does not pose handling or transportation problems.

CONCLUSION

The present invention provides a table that is versatile for a wide range of outdoor uses and activities and is easily transported by merely loosening a thumb set screw and folding the table to a substantially flat and stable position provided by the unique construction of the table. The table further includes a detachable rack whereupon articles such as lanterns may be hung. In addition, the table of the present invention may be inserted into the ground or easily attached to a wooden platform such as a deck.

Although the present invention has been described with reference to preferred embodiments, workers skilled in the art will recognize that changes may be made in form and detail without departing from the spirit and scope of the invention.

What is claimed is:

1. A table comprising:

a substantially vertical support member defining a substantially vertical axis and having a lower ground engaging portion and an upper portion;

first and second pivotal leaf members positioned about the vertical support member and pivotally attached to each other along adjacent sides;

first pivotal connecting means for pivotally connecting the first and second pivotal leaf members to each other such that the pivotal leaf members form a table surface when in an up position and are substantially parallel to each other and the vertical axis of the support member when in a down position;

support linkage means for pivotally connecting the first and second pivotal leaf members to the vertical support member such that the pivotal leaf members are pivotally connected to the vertical support member and for providing support to the leaf members in the up and the down position and when moving between the up and the down position and the support linkage means being positionable in a same plane with the vertical support member and a first pivotal connecting means and the first and second leaves being adjacent the support member when the leaves are in the down position forming a substantially flat folded table; and means for holding the first and second leaf members about the vertical support member when the first and second leaf members are in the up position and in the down position wherein the means for holding includes first and second leaf retainers positioned proximate the adjacent sides of the first and the second leaf members, each retainer having a main portion fixedly attached to an underside of the respective leaf member and having a retaining arm extending substantially perpendicularly therefrom, and wherein both leaves have recesses along the adjacent sides between the main portions of the retainers such that the vertical support member is substantially surrounded by the recesses when the leaves are in the up position and the vertical support member being substantially surrounded by the retainer arms when the leaves are in the down position.

2. The table of claim 1 wherein the support linkage means includes:

first adjustable connecting and locking means for connecting the first and second pivotal support linkage means to the vertical support and for use in adjusting height of the first and second leaf members along the vertical axis of the vertical support member and for locking the first and second leaf members at any height along said vertical axis;

first and second brace members supporting the first leaf and third and fourth brace members supporting the second leaf, each brace member having an upper end and a lower end with the upper end pivotally connected to the respective leaf member and the lower end pivotally connected to the first adjustable connecting and locking means;

upper pivotal connecting means for pivotally connecting the upper ends of each brace to the respective first and second leaf members; and lower pivotal connecting means for pivotally connecting the lower ends of each brace member about a common pivotal axis.

3. The table of claim 2 wherein the first adjustable connecting and locking means includes a first collar slidably engaging a periphery of the vertical support member and having a threaded aperture therethrough positioned substantially perpendicular to the vertical axis of the support member, and a screw threadably inserted within the threaded aperture and having an end for frictionally engaging an outer surface of the vertical support member such that the first collar is held in a fixed position along the vertical axis.

4. The table of claim 3 wherein the screw has a portion adapted for engagement with a thumb and finger for threading the screw within the aperture.

5. The table of claim 1 and further comprising:

an adjustable hanging means for hanging articles therefrom and adjustably connected to the upper portion of the vertical support member such that the height of the hanging means is adjusted along the vertical axis of the support member.

6. The table of claim 5 and further comprising:

second adjustable connecting and locking means for adjustably connecting the hanging means to the upper portion of the vertical support member and for locking the hanging means at a determined height along the vertical axis.

7. The table of claim 6 wherein the upper portion of the vertical support member has a passage and wherein the adjustable hanging means has a lower portion slidably disposed within the passage.

8. The table of claim 7 wherein the adjustable hanging means includes an upper portion substantially perpendicular to the lower portion for hanging various articles therefrom.

9. The table of claim 8 wherein the upper portion of the hanging means further includes a hook for hanging articles therefrom.

10. The table of claim 7 wherein the second adjustable connecting and locking means includes a second collar fixedly attached to an outer surface of the vertical support member and slidably engaging the lower portion of the hanging means and means for frictionally holding the lower portion of the hanging means at a fixed position.

11. The table of claim 10 wherein the means for frictionally holding includes a screw threadably engaging a threaded aperture in the second collar and having a distal end for frictionally engaging the lower portion of the hanging means for positioning the hanging means at a fixed position.

12. The table of claim 11 wherein the screw has a portion adapted for engagement with a thumb and finger for threading the screw within the threaded aperture.

13. The table of claim 1 wherein the ground engaging portion has a detachable pointed end for insertion into the ground.

14. The table of claim 1 wherein the ground engaging portion includes means for attaching the vertical support member to a platform.

15. A table comprising:

a substantially vertical support member having a substantially vertical axis and a lower ground engaging portion and an upper portion;

a foldable table top having at least two leaves positioned about the vertical support member and pivotable into a down position and into an up position;

means for pivotally connecting the two leaves to each other and the vertical support member such that the leaves are pivotable to the up and the down position;

first height adjusting means for adjusting the height of the table top with respect to the support member in both the up and down position;

hanger means for hanging articles attached to the upper end of the vertical support member;

second height of adjusting means for adjusting the height of the hanger means with respect to the upper portion of the support member; and means for holding the leaves about the vertical support member when the second leaves are in the up position and in the down position wherein the means for holding includes first and second leaf retainers positioned proximate adjacent sides of the leaves, each retainer having a main portion fixedly attached to an underside of the respective leaf member and having a retaining arm extending substantially perpendicularly therefrom, and wherein both leaves have recesses along the adjacent sides between the main portions of the retainers such that the vertical support member is substantially surrounded by the recesses when the leaves are in the up position and the vertical support member being substantially surrounded by the main portions and retaining arms when the leaves are in the down position.

16. The table of claim 15 wherein the hanging means is removable from the upper portion of the support member.

17. The table of claim 16 wherein the means for pivotally connecting includes:

hanging means for connecting the two leaves to each other; and support linkage means for supporting the two leaves and for pivotally connecting the two leaves to the vertical support member.

18. The table of claim 17 wherein the support linkage means includes;

a plurality of brace members supporting the two leaves, each brace member having an upper end and a lower end with the upper end pivotally connected to one of the leaves and the lower end pivotally connected to the first height adjusting means;

upper pivotal connecting means for pivotally connecting the upper ends of each brace to the respective leaf member; and lower pivotal connecting means for pivotally connecting the lower ends of each brace member about a common pivotal axis as other brace members such that the brace members are positioned to a same plane as the vertical support member when the leaves are in the down position.

19. The table of claim 15 and further comprising:

first locking means for locking the table top at a determined height along the vertical support member.

20. The table of claim 15 and further comprising:

second locking means for locking the hanger means at a determined height above the vertical support member.

* * * * *